US005685778A

United States Patent [19]

Sheldon et al.

[11] Patent Number: 5,685,778

[45] Date of Patent: Nov. 11, 1997

[54] RIDE ATTRACTION HAVING ANIMATED FIGURES

[75] Inventors: Benjamin Sheldon, Universal City; Jay Stein, Encino; Gary Goddard, North Hollywood; Adam Bezark, Glendale; Gene Leasure, Universal City, all of Calif.; Jane Jackson, Clermont, Fla.

[73] Assignee: Universal Studios, Inc., Universal City, Calif.

[21] Appl. No.: 660,420

[22] Filed: Jun. 7, 1996

[51] Int. Cl.[6] ..... A63G 25/00

[52] U.S. Cl. ..... 472/43; 472/128

[58] Field of Search ..... 472/57, 51, 54, 472/65, 117, 136, 137, 128, 13, 43; 40/415, 411, 414; 239/67, 69, 99, 101; 104/53

[56] References Cited

U.S. PATENT DOCUMENTS 3,082,699 3/1963 Schmitz ..... 472/43

5,403,238 4/1995 Baxter et al. ..... 472/43

5,473,990 12/1995 Anderson et al. ..... 472/43 X

*Primary Examiner*—Kien T. Nguyen

*Attorney, Agent, or Firm*—Lyon & Lyon LLP

[57] ABSTRACT

A ride attraction has vehicles on a vehicle path. An animated figure over or on one side of the vehicle path is concealed from the path, and passengers in the vehicles on the path, by a waterfall. As the vehicles approach the waterfall, a diverter closes off the waterfall or diverts the waterfall into sidewalls creating an opening and exposing the animated figure. Simultaneously, the animated figure moves forward through the waterfall, or the plane of the waterfall, and approaches the oncoming vehicle. The sudden emergence and movement of the animated figure from a concealed position behind the waterfall adds to the excitement of the ride attraction.

10 Claims, 2 Drawing Sheets

RIDE ATTRACTION HAVING ANIMATED FIGURES

BACKGROUND OF THE INVENTION

The field of the invention is ride attractions for theme or amusement parks.

Amusement or theme parks have become popular recreation destinations for children and adults. Ride attractions having vehicles, such as roller coaster cars or flume-type boats moving along a track or flume path, have long been popular. Animated figures have been used in ride attractions to better emphasize the theme of the attraction, to increase the realism or excitement provided, and to improve the overall ride experience. The movement or actuation of such animated figures in existing ride attractions is often initiated by the vehicle arriving at a selected location on the path, where the vehicle is detected, causing a ride controller to actuate the animated figure. After the vehicle passes by and moves away from the animated figure or scene containing the animated figure, the animated figure is reset to its original position, to be ready for the next approaching vehicle.

With the increasing sophistication and complexity of modem ride attractions, and the corresponding increase in expectations among theme or amusement park patrons, improved and more creative ride attractions are needed, including ride attractions having animated figures.

SUMMARY OF THE INVENTION

To these ends, a ride attraction includes a vehicle path preferably including an actuation position. Vehicles move on or over the vehicle path. An animated figure is advantageously positioned over or adjacent to the vehicle path, and separated from the vehicle path by a waterfall. Preferably, a diverter parts the waterfall as the vehicle passes underneath the waterfall, and the animated figure is revealed and moves out from behind the waterfall to approach the vehicle. The waterfall, advantageously together with fog/mist generators, conceals the mated figure, until the vehicle is near the actuation position. The sudden appearance and/or actuation of the animated figure increases the excitement and entertainment elements of the ride attraction. The animated figure preferably moves quickly toward the vehicle, to e.g., simulate an attack by an animal, dinosaur, etc.

Accordingly, it is an object of the invention to provide an improved ride attraction. Other and further objects and advantages will appear hereinafter.

BRIEF DESCRIPTION OF THE DRAWINGS

In the drawings, wherein similar reference characters denote similar elements throughout the several views.

DETAILED DESCRIPTION OF THE PREFERRED EMBODIMENT

Figures 1, 2, 5, 6:
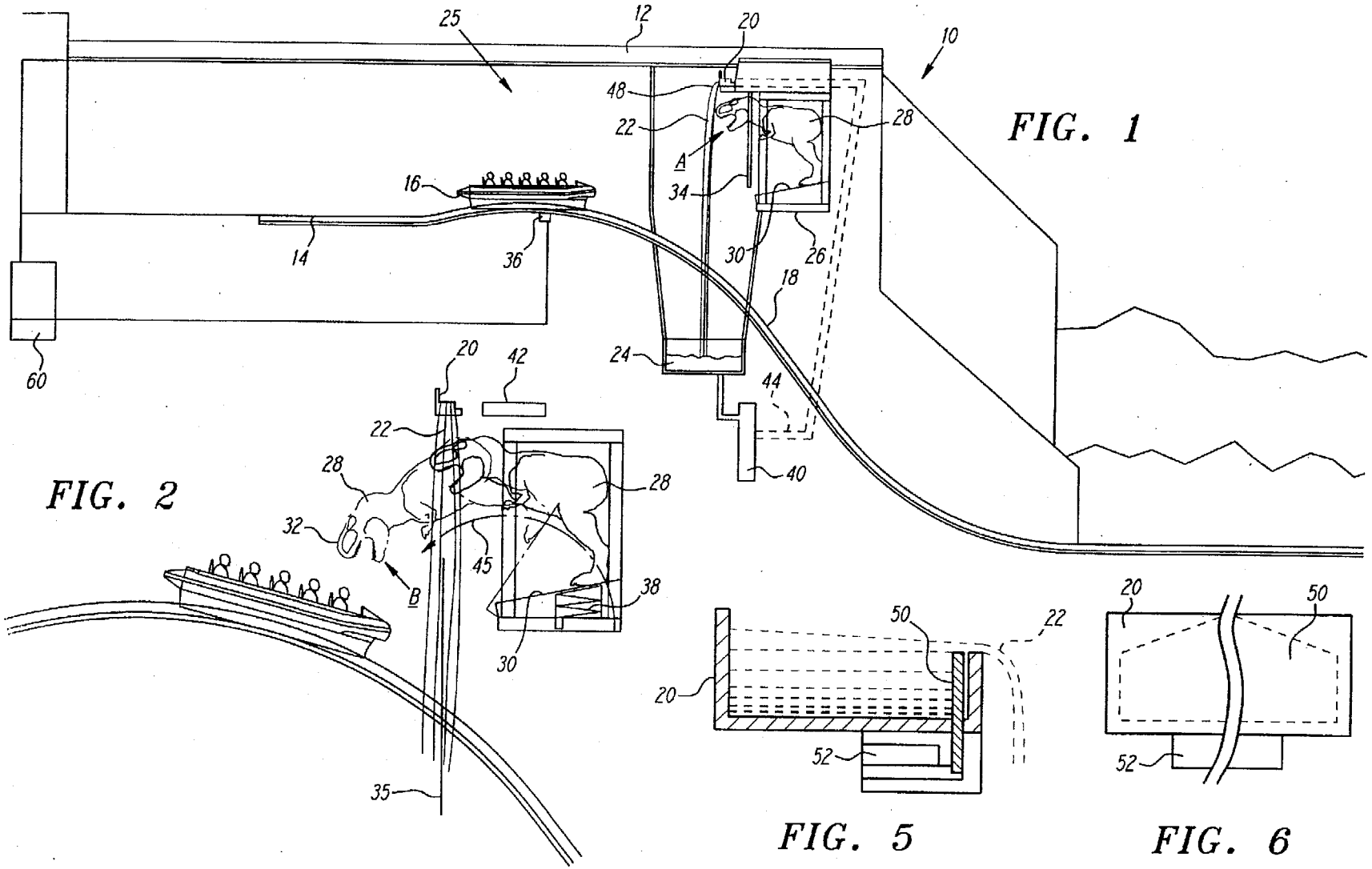
FIG. 1 is a schematically illustrated side elevation view of the present ride attraction.
FIG. 2 is an enlarged side elevation view of the animated figure and waterfall shown in FIG. 1.
FIG. 5 is a schematically illustrated side section view of the diverter shown in FIGS. 3 and 4.
FIG. 6 is a front view thereof.

Turning now in detail to the drawings, as shown in FIG. 1, the present ride attraction, in its preferred embodiment, includes a flume path 14 having a drop section 18 within a building 12. Vehicles or boats 16 move on or in the flume path 14. A waterfall 22 is provided adjacent to the top of the drop section 18. The waterfall is created by a waterfall trough 20, preferably concealed by a prop or scenery piece 48 consistent with theme of the ride attraction. A catch basin 24 is aligned with the waterfall 22, below the drop section 18 to catch the water. Flashing 46 is provided on the catch basin 24. A recirculating pump 40 and return pipes 44 recirculate the waterfall water from the catch basin 24 back to the waterfall trough 20, so that the waterfall 22 may be continuously maintained. A position sensor 36 is located at or near the flume path 14 on the approach to the waterfall 22. The position sensor 36 is linked to a ride/show controller 60.

A fog/mist generator 34 is located behind the waterfall 22 near the animated FIG. 28. The mist/fog generator 34 creates a dense fog in front of and behind the waterfall 22 by using a system of nozzles supplied with high pressure water.

Referring to FIGS. 1 and 2, an animated FIG. 28 is supported on a pivotable jack stand 30 on a pedestal 26 structurally supported by the building 12. An actuator 38 is connected to the jack stand 30.

Figure 3:
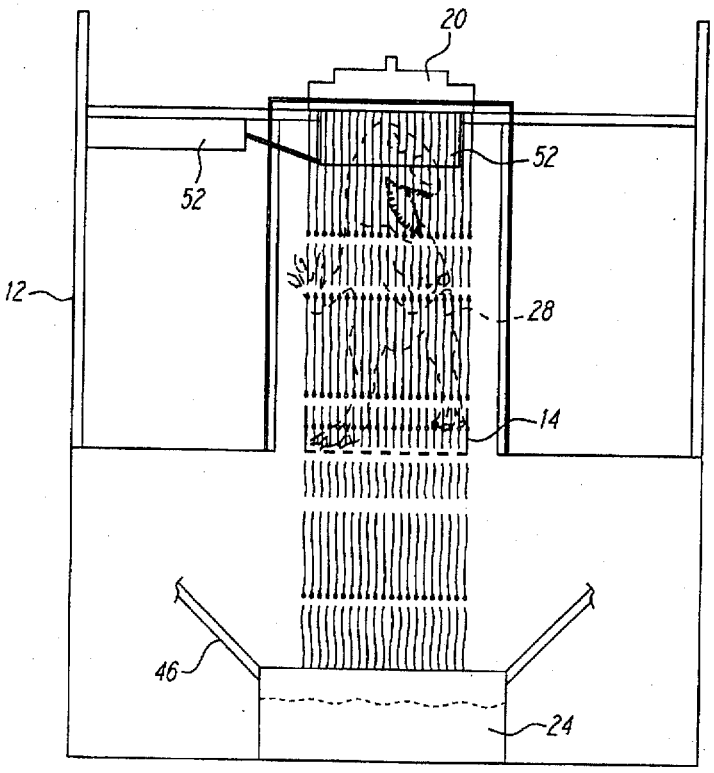
FIG. 3 is a front view of the ride attraction of FIGS. 1 and 2, with the waterfall concealing the animated figure.
Figure 4:
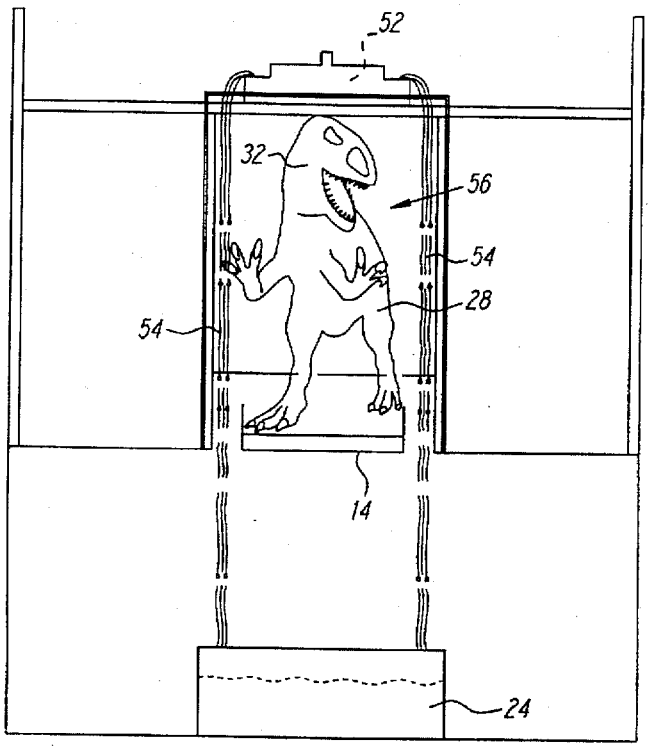
FIG. 4 is a front elevation view thereof showing the waterfall parted to reveal the animated figure.

Referring to FIGS. 3 and 4, a diverter 50 is displaceable into the waterfall trough 20 to divide the waterfall into side falls 54. A diverter actuator 50 for moving the diverter up and down is linked to the controller 60. The diverter is a plate-like weir surface having an angled top, as shown in FIG. 6

In operation, as the boat or vehicle 16 approaches the animated figure scene 25, the waterfall 22 conceals the animated FIG. 28, by creating a generally continuous sheet of falling water. The waterfall 22 prevents the passengers in the boat 16 from seeing the animated FIG. 28, or the drop 18. When the boat 16 reaches the position sensor 36 (at an actuation position), the diverter actuator 52 moves the diverter 50 into a diverting position in the waterfall trough 20, as instructed by the controller 60. The angled sides of the diverter cut off flow progressively from the center to the sides, as the diverter rises. With the diverter in the diverting position, the waterfall 22 is parted, as shown in FIG. 4, revealing the animated FIG. 28. Simultaneously, or after a short delay, the jack stand actuator 38 moves the jack stand 30 up. The animated FIG. 28 moves through the plane 35 of the waterfall, from position A in FIG. 1 to position B in FIG. 2, to "attack" the passengers. In the embodiment illustrated, the head 32 of the animated FIG. 28 travels quickly over a relatively long actuation distance, beginning from a concealed position, thereby adding to the excitement of the ride attraction 10. The jack stand 30 moves in a circular arch 45 (on a pendulum) from the concealed position A to the fully extended "attack" position at B. Other actuators and movement patterns, e.g., straight, dropping, etc. may also be used. During the "attack" sequence, the limbs, neck, head, mouth, eyes, etc. of the animated FIG. 28 advantageously move in a predetermined "attack" sequence, using known techniques. Immediately after the "attack" sequence, the boat or vehicle 16 plunges down the drop section 18. As the drop section 18 is concealed until the waterfall is parted, the plunge cannot be seen or anticipated by the passengers. The sudden drop and acceleration increases the excitement provided by the ride attraction.

As the volume of water in the sidewalls 54 is much less than the full width waterfall 22, a return trough 42 is provided to hold the excess water built up during the interval when the waterfall 22 is reduced to the sidewalls 22. The return trough 42 also stores water to supply the waterfall trough 20. The recirculating pipes 44 preferably deliver water to the return trough.

The fog/mist generator 34 create additional fog or mist around the waterfall 22, to better conceal the animated FIG. 28. The fog/mist generator 34 may be turned off just prior to the "attack" sequence.

In the specific embodiment shown, the scenery 48 around the waterfall trough 20 is a five foot diameter pipe (seemingly damaged and leaking from prior attacks). Other equivalent scenery such as a water tank or a natural waterfall may also be used. The waterfall 22 is about 16 feet wide. Before the boat 16 passes through the waterfall, the opening 56 (about 11 feet wide) is created between the side falls 54 by the pneumatically actuated diverter. The catch basin 24, in the design shown, is about eight feet tall, eight feet wide and 24 feet long. The waterfall drop from the waterfall trough 20 to the path 14 on the drop section 18 is about 44 feet, with the top of the catch basin 24 positioned about an additional 12 feet below the path 14.

Various modifications and substitution of equivalents may of course be made without departing from the invention. For example, the animated FIG. 28 may be made to move through the waterfall 22, while the waterfall is continuous and not diverted, as shown in FIG. 3, or with a continuous waterfall having reduced flow, e.g., a heavy rain. The animated figure scene 25 may be reoriented or placed outdoors. The animated figure and waterfall may also be used in the live action show, with the waterfall initially concealing the animated figure (e.g., on a stage) and the animated figure then emerging from the waterfall. In place of the boat 16, various other vehicles may be used. Other modifications will also be apparent to person skilled in the ride attraction art. The invention, therefore, should not be restricted, except in the spirit of the following claims.

We claim:

1. A ride attraction comprising:

a vehicle path having an actuation position;

a vehicle movable on the vehicle path;

an animated figure adjacent to the vehicle path;

a waterfall separating the animated figure from the actuation position of the vehicle path;

a diverter for diverting the waterfall away from the vehicle path; and an actuator for moving the animated figure through the waterfall towards the actuation position.

2. The ride attraction of claim 1 further comprising a catch basion below the vehicle path and under the waterfall.

3. The ride attraction of claim 1 further comprising fog generators adjacent to the animated figure.

4. The ride attraction of claim 1 further comprising a vehicle sensor adjacent to the actuation position, with the vehicle sensor linked to a controller and the controller linked to the actuator.

5. The ride attraction of claim 1 further comprising a return trough connected to the waterfall trough.

6. The ride attraction of claim 1 further comprising a drop section on the flume path, with the waterfall positioned over and across the drop section.

7. A method of operating an amusement ride attraction comprising the steps of:

moving a vehicle on a vehicle path to an actuation position;

creating a waterfall between the actuation position and an animated figure; and moving the animated figure through the waterfall toward the actuation position.

8. The method of claim 7 further comprising the step of forming a gap in the waterfall and moving the animated figure through the gap.

9. The method of claim 7 further comprising the step of moving the animated figure in a downwardly curving arc.

10. A ride attraction comprising:

a vehicle path having an actuation position and a drop section;

a vehicle movable on a vehicle path;

a waterfall positioned over and across the path between the actuation position and the drop section; and a diverter for diverting or stopping the waterfall when the vehicle approaches the actuation position.

* * * * *